United States Patent [19]

Sokolowski

[11] 4,101,018

[45] Jul. 18, 1978

[54] PAPER EDGE SENSOR

[75] Inventor: Eugene K. Sokolowski, Chicago, Ill.

[73] Assignee: Teletype Corporation, Skokie, Ill.

[21] Appl. No.: 773,246

[22] Filed: Mar. 1, 1977

Related U.S. Application Data

[63] Continuation of Ser. No. 606,959, Aug. 22, 1975, abandoned.

[51] Int. Cl.[2] ..... B41J 29/44; B41F 13/00

[52] U.S. Cl. ..... 400/582; 101/235; 271/3; 400/622; 400/645; 400/708

[58] Field of Search ..... 101/232–236, 101/409; 271/273–276, 193, 3; 107/141, 189; 348/137, 138

[56] References Cited

U.S. PATENT DOCUMENTS

| | | | |
|---|---|---|---|
| 1,007,581 | 10/1911 | Lewis | 197/126 R |
| 1,351,175 | 8/1920 | Lehr | 101/234 |
| 1,930,605 | 10/1933 | Bohmert | 197/126 R |
| 2,635,533 | 4/1953 | Stewart | 101/40 |
| 2,903,965 | 9/1959 | Eichenbaum et al. | 101/235 |
| 2,908,220 | 10/1959 | Eichenbaum et al. | 101/234 X |
| 3,089,746 | 5/1963 | Bryer | 271/3 X |
| 3,203,074 | 8/1965 | Monaghan | 346/138 X |
| 3,239,215 | 3/1966 | Davis et al. | 271/277 |
| 3,241,831 | 3/1966 | Axliel | 271/265 X |
| 3,258,530 | 6/1966 | Fowlie et al. | 271/3 X |
| 3,335,661 | 8/1967 | Moschetti et al. | 101/235 |
| 3,373,685 | 3/1968 | Adams | 271/263 X |
| 3,405,633 | 10/1968 | Price, Jr. et al. | 101/38 A |
| 3,468,279 | 9/1969 | Tseo | 101/235 |
| 3,502,323 | 3/1970 | Dempsey | 271/3 |
| 3,578,315 | 5/1971 | Milford | 271/263 |
| 3,609,724 | 12/1969 | Allison et al. | 271/196 X |
| 3,618,123 | 11/1971 | Buddendeck | 346/138 |
| 3,663,012 | 5/1972 | Honert | 271/276 |
| 3,831,727 | 8/1974 | Kruspe | 197/1 R |
| 3,834,289 | 9/1974 | Behrens et al. | 271/265 X |
| 3,898,930 | 8/1975 | Ikegami | 101/233 X |

*Primary Examiner*—Louis G. Mancene
*Assistant Examiner*—Paul J. Hirsch
*Attorney, Agent, or Firm*—W. G. Dosse; J. C. Albrecht

[57] ABSTRACT

Paper is carried on an apertured platen and is rotated past a slowly moving printing head so as to scan in a raster fashion from top to bottom and from left to right over the surface of the paper. The paper is held to the platen drum by a vacuum that is applied to the inside of the platen. A valve is located at the entrance of the vacuum system of the platen in order to rapidly dissipate the vacuum so as to release or remove the paper from the still rapidly rotating platen. To facilitate inserting and releasing paper, a shroud system is placed very close to the periphery of the drum and guides the paper during insertion to close proximity with the vacuum. An exit door is provided in the shroud at a convenient location to permit the paper to exit from the drum once the vacuum has been dissipated. The size of the drum is made such that its circumference is slightly less than the length of the paper so as to provide overlap of the top and bottom edges of the paper. A light beam is directed tangential to the platen and is blocked once per revolution by the projection of flap of the overlapping edge of the paper. A photocell is placed opposite the light source and senses the temporary blockage of the light beam by the overlapping edge of the paper as the platen rotates.

2 Claims, 4 Drawing Figures

PAPER EDGE SENSOR

This application is a continuation of my copending application, Ser. No. 606,959, filed Aug. 22, 1975 now abandoned.

FIELD OF THE INVENTION

The present invention relates to platen drum printing and more particularly to determining the location on the platen of the top edge of the paper.

BACKGROUND OF THE INVENTION

When paper is held to a platen by vacuum rather than clamps at the leading edge of the paper, there must be a way to determine when the leading edge of the paper passes the printing station. Otherwise, there is no way to synchronize the message to be printed on the paper with the dimensions of the paper. This problem arises because vacuum attraction of paper onto a platen is an asynchronous operation on which the leading edge of the paper can be picked up by the platen at any rotational position. Additionally, since vacuum can pick up the paper at any rotational position of the platen, it is desirable not to waste vacuum or otherwise permit excessive amounts of air to dissipate the vacuum in order to promote firm gripping of the paper onto the platen.

Therefore, it is an object of the present invention to minimize the passage of air into a vacuum-operated, record-carrying platen.

It is another object of the present invention to determine the location of the leading edge of the paper wrapped around a vacuum platen.

Still another object of the invention is to control the phasing of the printing operation on a sheet of paper wrapped around a rotating platen.

It is yet another object of the present invention properly to phase removal of vacuum from the drum for ejecting paper from the rotating platen.

SUMMARY OF THE INVENTION

In accordance with the present invention, in a printing apparatus having a rapidly rotating drum for carrying a record medium repeatedly past a printing station which selectively prints indicia on the record medium, a system for initiating a cycle of operation of the printing apparatus at a consistent distance from a leading edge of the record medium by holding the record medium to the drum with the trailing edge of the record medium extending in a tangential direction away from a drum, sensing the movement of the trailing edge past a fixed position on the printing apparatus, sensing incremental rotation of the drum and producing a print signal at a predetermined time interval after sensing the trailing edge of the record medium, the time interval related to the speed of rotation of the drum, the distance between sensing and printing and the size of the top margin of the record and starting the outpulsing of indicium-forming signals in response to a print signal and outpulsing successive indicium-forming signals in response to subsequent incremental rotation of the drum.

BRIEF DESCRIPTION OF THE DRAWINGS

The present invention will be more readily understood by referring to the following detailed description when considered in conjunction with the accompanying drawings wherein like reference numbers refer to the same or similar parts throughout the several views.

DETAILED DESCRIPTION

Figure 1:
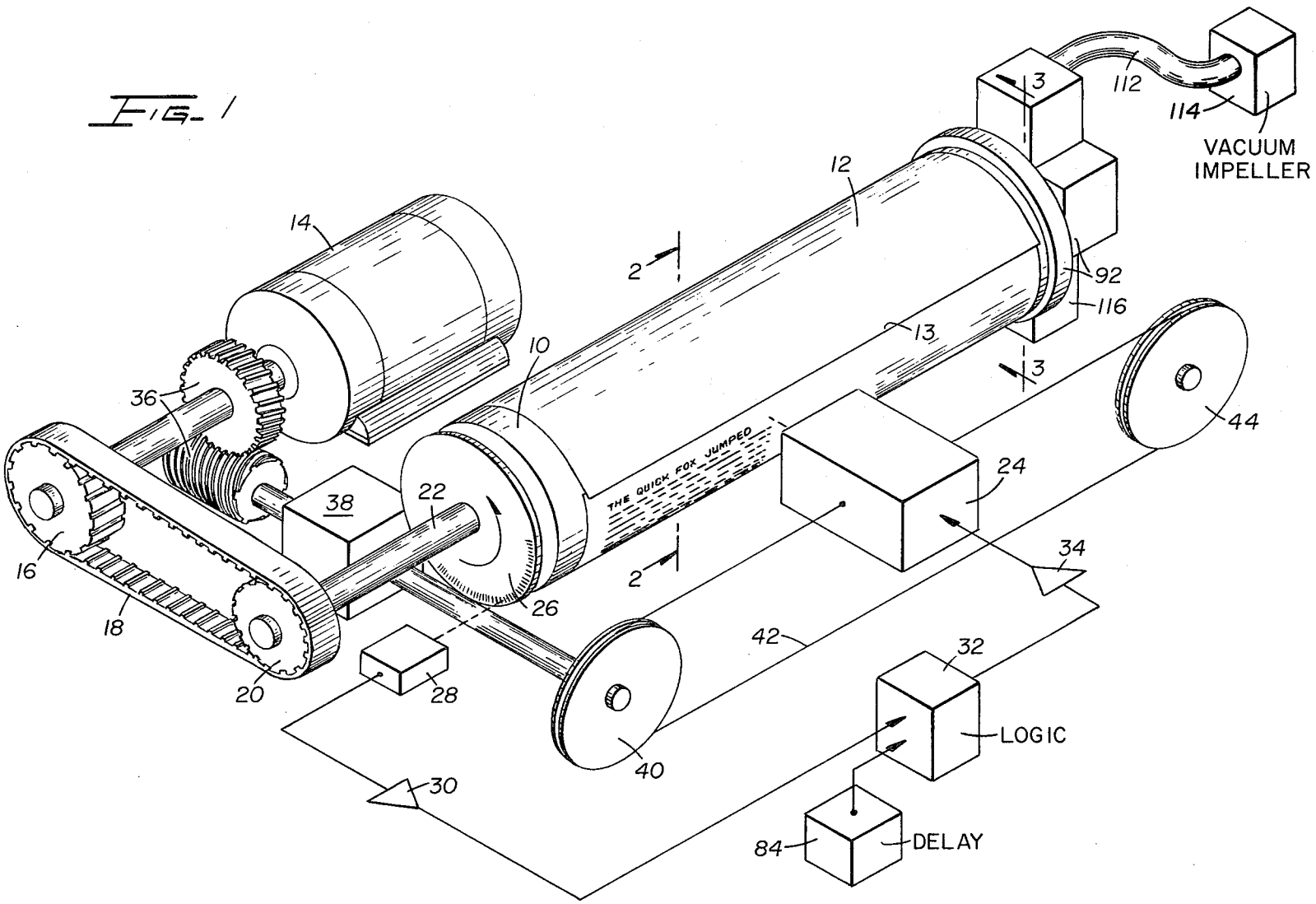
FIG. 1 is a schematic diagram in perspective of an ink jet printer with many components removed and simplified for clarity.

Referring now to the drawings and more particularly to FIG. 1, a platen 10 has a sheet of paper 12 wrapped around it with slight lap of the bottom or trailing edge 13 over the top edge. A motor 14 drives a toothed driving pulley 16, an internally-toothed belt 18, and a toothed driven pulley 20 mounted on an axle 22 of the platen 10 to rotate the platen 10 at high speed.

A print head 24 is arranged to move in a direction parallel to the axle 22 of the platen 10. Therefore, as the platen 10 rotates and carries the paper 12 with it, the loci of the points on the paper 12 as they pass in front of the print head 24 comprise a raster scan pattern. The print head 24 is preferably of the ink jet variety in which a stream of ink drops is arranged to impinge selectively upon the paper 12 as the raster scan is accomplished. Whenever the ink jet is in the ON condition; it marks the paper. When the ink jet is in the OFF condition, no ink reaches the paper; and it remains white.

In order to synchronize the operation of the ink jet, a timing disc 26 is mounted on the axle 22 and rotates with the platen 10. A pickup 28 senses the passage of increments along the disc 26 and sends signals through an amplifier 30 to a logic circuit 32 which may be any one of many different such ink jet logic circuits known to the prior art. The logic circuit 32 delivers a charging signal through amplifier 34 to the print head 24 for controlling the flow of ink drops to the paper 12. In order to move the print head 24 from left to right parallel to the axis of axle 22 of the platen 10, a right-angle gear set 36 is driven by the motor 14. The gear set 36 drives through a clutch and transmission 38 which can be of any conventional type capable of coupling motion in either direction and at various speeds, such for example as would be used to drive the table of a milling machine. The output of the clutch and transmission 38 is coupled to a pulley 40 around which a cable 42 is passed and tensioned by an idler pulley 44. The cable 42 is connected at its two ends to the print head 24; and as the pulley 40 is rotated by the clutch and transmission 38 in synchronism with the rotation of the platen 10, the print head 24 is advanced from left to right across the paper 12.

Figure 2:
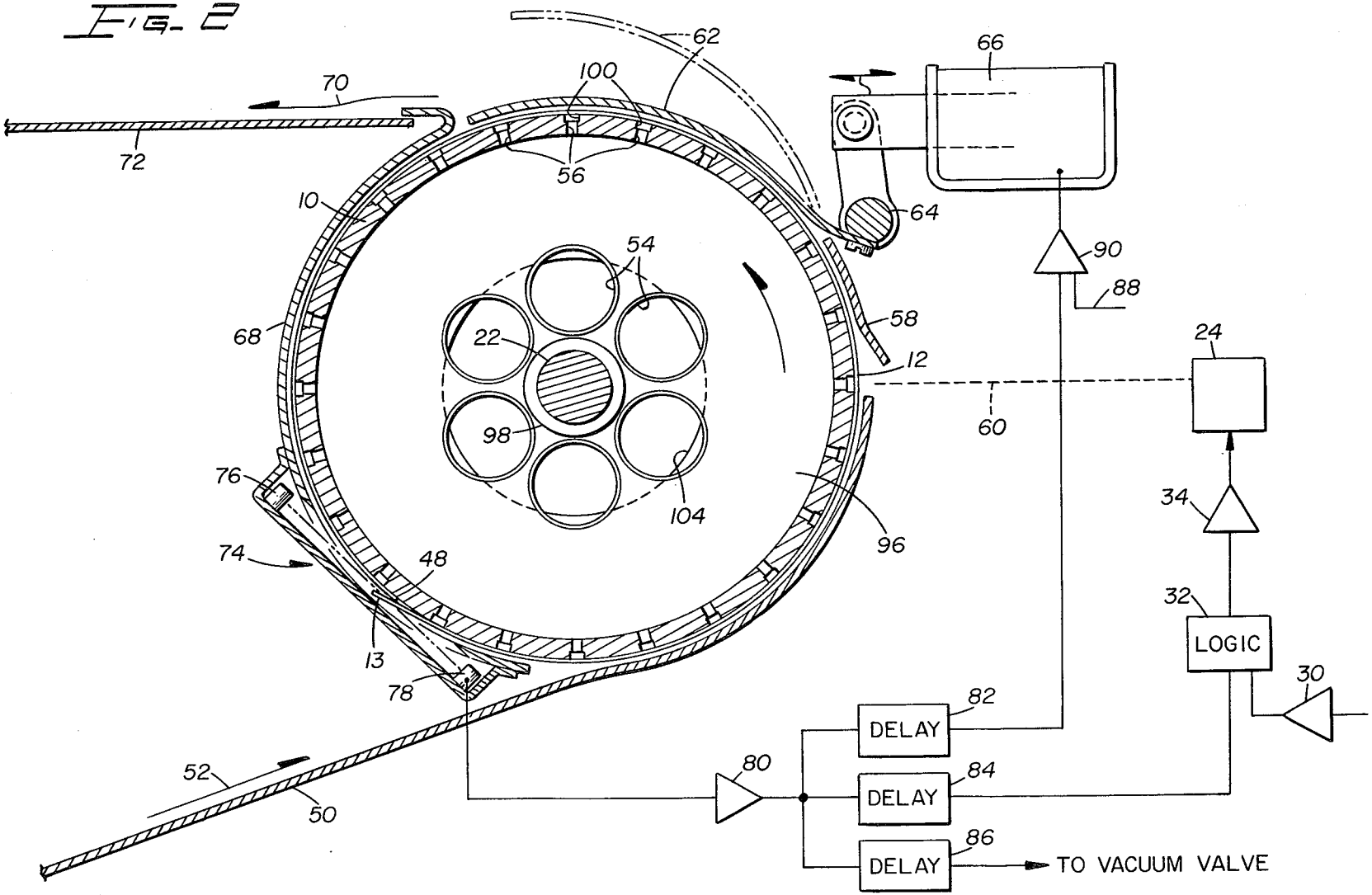
FIG. 2 is a drawing in cross-section taken along lines 2—2 of FIG. 1 and shows the shroud structure and photocell edge sensor omitted in FIG. 1.

Referring now to FIG. 2, a cross-sectional view is shown of the platen 10 having the sheet of paper 12 wrapped around it such that the trailing edge 13 of the sheet of paper overlaps the leading edge 48 at some point on the periphery of the platen 10. In addition to the platen 10 and paper 12 shown in FIG. 1, FIG. 2 shows a shrouding arrangement around the periphery of the platen 10 which was omitted for clarity in FIG. 1. In order to deliver paper for carriage by the platen 10, paper is inserted along an entry shroud 50 in the direction of an arrow 52. The paper follows a path between the rotating platen 10 and the shroud 50 which area is highly constricted since the shroud is very close to the platen 10. A vacuum system is connected to the interior of the platen 10 through a plurality of apertures 54 at one end of the platen 10 such that the interior of the platen is at a substantially negative gauge pressure. A plurality of apertures 56 are arranged about the periphery of the platen 10 and also axially along its length. The apertures 56 communicate this vacuum to the outer surface of the platen 10 in order to attract the paper 12 against the platen 10.

As the paper is inserted in the direction of the arrow 52 it is initially simply scraped by the surface of the platen 10 because not enough area of contact exists between the paper and the platen 10 to grip the paper. However, as the paper continues to be inserted either manually or by automatic paper feeding apparatus in the direction of the arrow 52, sufficient surface is finally engaged between the platen 10 and the paper to cause the platen to grip the paper and wrap the paper around the platen 10. The entry shroud 50, of course, gradually brings the paper in close proximity to the platen 10 with sufficient clearance to prevent interference or excessive friction during rotation of the platen.

It has been found that with a vacuum of approximately 2¼ inches of water, approximately 240° of arc of engagement between a 20-pound weight grade of paper and an aluminum drum platen 10 is necessary to cause the drum to grip the paper and begin spinning the paper around its periphery. Somewhat lighter grades of paper may require less arcuate engagement before the vacuum grips the paper. The size of the platen 10 is chosen such that its outer circumference is equal to approximately one-eighth inch less than the length of the paper 12. In this way, the leading edge 48 and trailing edge 13 overlap will occur as illustrated in FIG. 2.

A second shroud 58 further constrains the paper and prevents it from leaving the area between the drum and the shroud. The shroud 58 is spaced from the entry shroud 50 by an opening through which the ink jet 60 from the printing head 24 can enter between the shrouds 50 and 58 and strike the paper 12 at any point along the axis of the platen 20.

Another portion of the shroud comprises an exit door 62 which is normally in the position shown in solid lines and cross section in FIG. 2. In this position, the exit door 62 is parallel to the circumference of the platen 10 and forms a continuation of the shrouding initiated by the entry shroud 50 and the second shroud 58. The exit door 62 is mounted so as to rotate about a pivot 64 in order to open at an appropriate point in the cycle of the printer. When the exit door is to be opened, a solenoid magnet 66 is energized and moves the door 62 from the position shown in solid section lines in FIG. 2 to the position shown in phantom lines in FIG. 2. The shroud system around the platen 10 is completed by a rear shroud 68 which extends from the exit door 62 around to the entry shroud 50.

In the normal operation of the printer, the exit door 62 is in the position shown in solid lines in FIG. 2 and the platen 10 is rotating at a speed in the range of 1371 revolutions per minute. However, when printing has been completed, and it is desired to remove the paper 12 from the platen 10, the exit door 62 is opened to the position shown in phantom lines in FIG. 2 and the vacuum that has been communicated to the interior of the platen 10 through the apertures 54 is replaced by substantially atmospheric pressure. This releases the paper 12 from the platen 10, and as the paper springs away from the platen by centrifugal force and its own stiffness, the leading edge 48 of the paper exits from the area of the platen 10 through the exit door 62 and progresses in the direction of an arrow 70 onto the surface of a tray 72 which may be a part of the printer cabinet.

EDGE SENSOR

The paper 12, as mounted on the platen 10, has no fixed relationship with the angular position of the platen 10. Therefore, the position of the paper 12 must be determined independently of the angular position of the platen. The timing disc 26 is then used only to indicate increments of the platen and not absolute positions of the paper.

Referring again to FIG. 2, at some convenient point around the periphery of the platen 10, the rear shroud 68 contains an edge sensor structure 74. This edge sensor 74 contains a light source 76 which is arranged to project a beam of light substantially tangential to the platen 10. A light sensor 78, preferably a photocell of some kind, is arranged to intercept the beam of light from the light source 76 that manages to pass tangentially along the periphery of the platen 10. However, when the overlapped trailing edge 13 of the paper 12 is in the position shown in FIG. 2, the trailing edge 13 extends tangentially to the surface of the platen and in fact is bent out slightly by reason of its attraction near the leading edge 48 of the paper. In the position shown in FIG. 2, the trailing edge 13 intercepts and blocks the light path between the light source 76 and the light sensor 78. At the moment of interruption of the beam of light, the light sensor 78 issues a signal through an amplifier 80 to a plurality of delay circuits 82, 84 and 86. These three delays provide the phasing between the position of the paper on the rotating platen 10 and the printing and ejection controls of the printer.

When the print head 24 has reached the right-hand margin of the platen 10, the paper is to be ejected from the printer. An eject signal is present on a wire 88 and energizes an amplifier 90. As the edge sensor 74 senses the presence of the trailing edge 13 in the position shown in FIG. 2, the delay 82 times an appropriate interval until the leading edge 48 is in an appropriate position. The delay 82 then energizes the amplifier 90 which has been primed by the signal on the eject wire 88. The amplifier 90 then operates the magnet 66 to open the exit door 62 in the shrouding system about the platen 10. The same edge sensing signal passing through the amplifier 80 also energizes the delay 86 at an appropriate time sends a control to the vacuum valve control (FIGS. 3 and 4) in order to terminate the vacuum in the inside of the platen 10 at the appropriate instant to permit ejection of the paper.

During the printing cycle, at each revolution of the platen 10, the edge sensor 74 also sends a signal through the delay circuit 84 which energizes the logic circuit 32. This is a print-phasing signal and indicates to the logic circuit 32 that the top of the sheet of paper is now in the printing position. The delay circuit 84 is, of course, adjusted appropriately to coincide with the time required for the leading edge 48 of the paper 12 to move from the sensing position shown in FIG. 2 up to the position in which it is in line with the ink jet 60.

VACUUM SYSTEM

Figure 4:
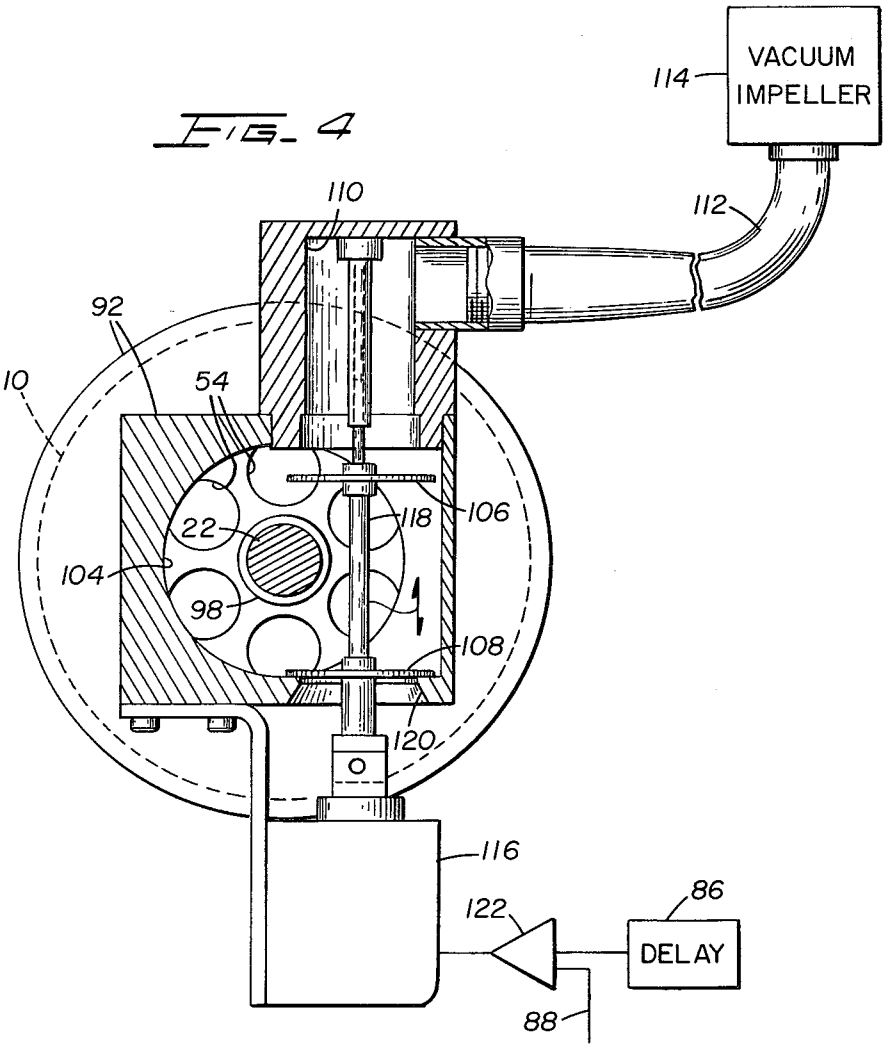
FIG. 4 is an end view in cross-section of the vacuum chest taken along line 4—4 of FIG. 3.
Figure 3:
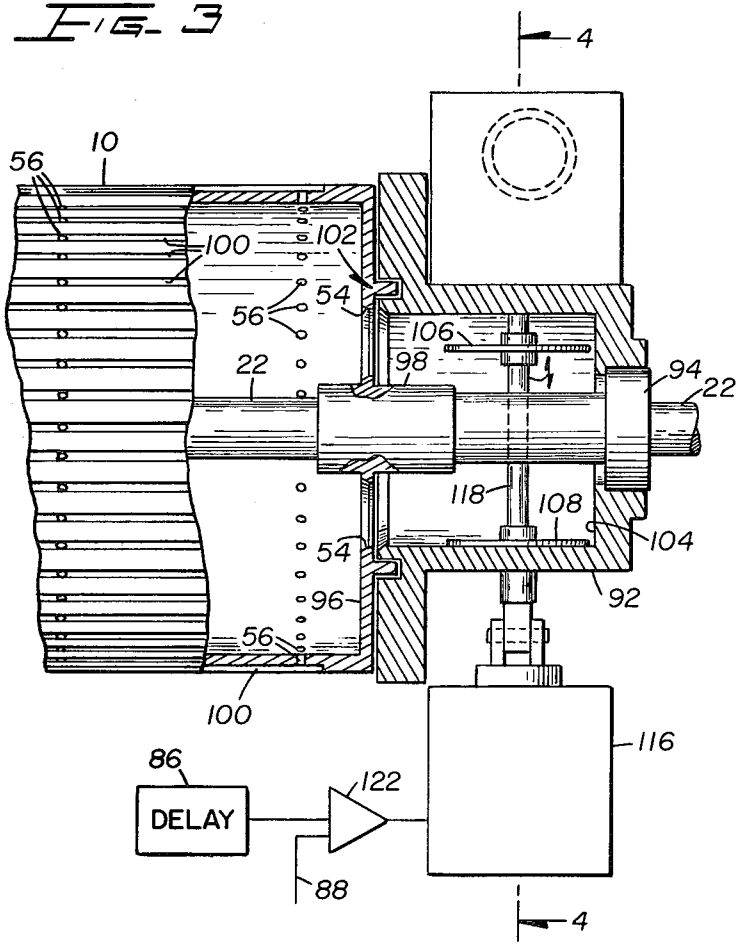
FIG. 3 is a front view partially in cross-section taken along lines 3—3 of FIG. 1.

Referring now to FIGS. 3 and 4, a stationary end frame 92 is shown with the axle 22 rotatably supported thereon by a bearing 94. The platen 10 is shown partially in cross section and is supported on an end plate 96 which contains the apertures 54 and which is firmly mounted on a collar 98 that rotates with the axle 22. The platen 10 is shown with the apertures 56 arranged circumferentiall around the platen 10 and in axially spaced rows. A plurality of grooves 100 extends axially along the periphery of the platen 10 and link the apertures 56 so as to increase the effective vacuum area on the surface of the platen.

An air seal 102 is provided between the end plate 96 and the end frame 92. The purpose of the seal is to permit relatively free rotation of the end plate 96 with respect to the end frame 92 but to minimize the leakage of air from the atmosphere into the inside of the platen 10. The end frame 92 is constructed so as to form a vacuum chest 104 which is open in the direction of the end plate 96 so as to permit easy flow of air from the interior of the platen 10 through the apertures 54 and to the interior of the vacuum chest 104.

Referring to FIG. 4., the vacuum chest 104 has a pair of plate valves 106, and 108. The plate valve 108 is an air valve. The plate valve 106 is a vacuum valve and controls the flow of air between the interior of the valve chest 104 and a vacuum pipe 110 which is connected by a vacuum hose 112 to a vacuum source 114 which is preferably a vacuum cleaner impeller and motor which is preferably designed for long life. The vacuum source 114 provides the vacuum to the interior of the vacuum pipe 110, and this vacuum is selectively communicated to the interior of the vacuum chest 104 and via the apertures 54 to the interior of the platen 10. The vacuum valve 106 is shown in FIG. 4 in its open position in which vacuum is applied through the apertures 56 to the grooves 100 so as to attract paper to the surface of the platen 10.

The valves 106 and 108 are controlled by a magnet 116 which is capable of axially moving a valve stem 118 on which the valves 106 and 108 are firmly mounted. If it is desired to release the paper from the platen 10, the magnet 116 is energized to drive the valve stem in the upward direction as shown in FIGS. 3 and 4 so as to close the vacuum valve 106 and open the air valve 108. The air valve 108, when closed, covers an air port 120 and when open communicates the atmosphere through the air port 120 into the vacuum chest 104 and through the apertures 54 into the interior of the platen 10 in order to dissipate the vacuum and thus release the paper.

The magnet 116 is controlled in exactly the same way as the magnet 66 of FIG. 2 in that the edge sensor 74 senses the passage of the trailing edge 13 and energizes the delay 86. The delay 86, after an appropriate interval, energizes an amplifier 122. If a paper eject signal is present on the wire 88 (in the manner similar to that described in conjunction with the magnet 66) the amplifier 122 then energizes the magnet 116 at the appropriate moment to move the valve stem 118 upwardly and thus dissipates the vacuum within the platen 10, in order to cause the ejection of the paper 12 through the exit door 62.

Although only one specific embodiment of the invention is shown in the drawings, and described in the foregoing specification, it will be understood that invention is not limited to the specific embodiment described, but is capable of modification and rearrangement and substitution of parts and elements without departing from the spirit and scope of the invention.

What is claimed is:

1. In a printing apparatus, a rapidly-rotating drum for carrying a record medium having two edges repeatedly past a printing means which selectively prints indicia on the record medium, a system for initiating a cycle of operation of the printing apparatus at a consistent distance from a leading one of the two edges of the record medium, comprising:

means for holding the record medium to the drum with a trailing one of the two edges and a length of the record medium attached thereto extending in a tangential direction away from the drum;

means for sensing the passage of said trailing edge past a fixed position on the printing apparatus;

means for sensing incremental rotation of the drum;

delay means responsive to the sensing means for producing a signal a predetermined time interval after the sensing means senses the trailing edge of the record medium, the time interval related to the speed of rotation of the drum, the angular distance between the sensing means and the printing means, and the top margin of the record; and logic means responsive to the signal produced by the delay means for starting the outpulsing of indicium-forming signals to the printing means and responsive to sensing of subsequent incremental rotation of the drum for outpulsing successive indicium forming signals to the printing means.

2. An apparatus according to claim 1 further including in the logic means, means for terminating the outpulsing of indicium-forming signals prior to the next signal from the delay means following the next passage of the trailing edge past the sensing means.

* * * * *